US005452754A

United States Patent [19]

Yasui

[11] Patent Number: 5,452,754

[45] Date of Patent: Sep. 26, 1995

[54] CENTRIFUGAL CASTING APPARATUS

[75] Inventor: Shozui Yasui, Tokyo, Japan

[73] Assignee: M. Yasui & Co., Ltd., Tokyo, Japan

[21] Appl. No.: 165,109

[22] Filed: Dec. 10, 1993

[30] Foreign Application Priority Data

Dec. 15, 1992 [JP] Japan ..... 4-333389

[51] Int. Cl.[6] ..... B22D 13/06; B22D 13/10

[52] U.S. Cl. ..... 164/287; 164/289

[58] Field of Search ..... 164/287, 289; 425/425

[56] References Cited

U.S. PATENT DOCUMENTS

| | | | |
|---|---|---|---|
| 1,331,660 | 2/1920 | Mortonson et al. | 164/287 |
| 2,265,043 | 12/1941 | Moore | 164/287 |
| 2,752,650 | 7/1956 | Bosna | 164/287 |
| 3,735,800 | 5/1973 | Huppert et al. | 164/289 X |
| 4,167,381 | 9/1979 | Hilmde | 164/289 X |
| 4,524,816 | 6/1985 | Plowman et al. | 164/287 |

FOREIGN PATENT DOCUMENTS

| | | | |
|---|---|---|---|
| 2020910 | 11/1971 | Germany | 164/289 |
| 462492 | 3/1951 | Italy | 164/289 |
| 2-169164 | 6/1990 | Japan | 164/289 |

*Primary Examiner*—J. Reed Batten, jr.

*Attorney, Agent, or Firm*—Dorn, McEachran, Jambor & Keating

[57] ABSTRACT

With the centrifugal casting apparatus, the rotating arm is never loosened to thereby obtain good casting quality even if rapid variation in speed is generated upon rotating of the rotating arm at high speed. The centrifugal casting apparatus is provided with a rotating shaft 51, a rotating arm 1 fixed to the shaft 51, a crucible 3, a mold 4 and the like provided at one end of the arm 1, and a balance weight 2 provided at the other end. The apparatus is provided with arm fixing bolts **12*a*, 12*b* for fixing the arm 1 to the shaft 51 and positioned so as to be deviated from the rotational center 15 of the shaft 51. The rotating shaft 51 is provided with fulcrum pins 18*a*, 18*b* serving as fulcrum for balance of the arm 1. The fulcrum pins 18*a*, 18*b* protrude from the shaft 51 when the balance of the arm 1 is adjsted, and retract into the shaft 51 when the arm 1 and the shaft 51 are fixed. The apparatus is further provided with the engaging portions in which the shaft 51 and the arm 1 are connected, the engaging portions having faces inclined relative to the shaft 51**.

15 Claims, 6 Drawing Sheets

CENTRIFUGAL CASTING APPARATUS

BACKGROUND OF THE INVENTION

1. Field of the Invention

The present invention relates to a centrifugal casting apparatus suitable for precision casting of jewelry, dental articles, artistic handicraft, precision machine parts or the like.

2. Related Background Art

The centrifugal casting apparatus for precision casting is provided with a horizontal rotating arm connected to the upper part of a vertical rotating shaft, the arm being provided, at an end thereof with respect to a rotational center thereof, with a crucible, a receiver for mounting the crucible and a mold positioned at the external periphery side and, at the other end, with a balancing weight. The molten metal in the crucible is poured into the mold to effect casting by the centrifugal force generated by the rotation of the rotating shaft in the centrifugal casting apparatus. For melting the metal in the crucible, there is generally employed high frequency induction heating, by providing a coil around the crucible and applying a current to the coil, thereby inducing high frequency in the metal to achieve heating thereof.

The metal employed in precision casting can be an elementary metal or an alloy, such as gold, silver, platinum, paradium, rhodium, nickel, white gold, copper alloys, white metal, carbon steel, stainless steel, cast iron, heat-resistant steel, wear-resistant alloy, nickel alloys or aluminum alloys, but these examples are not limitative.

The mold is prepared, for example, by the known lost wax process.

FIG. 9 shows a perspective view of the connecting portion between the rotating shaft and the rotating arm in the conventional centrifugal casting apparatus. As shown therein, the rotating arm 52 is provided with a fixing member 52*a* for connection with the rotating shaft 51, a balance-side arm 53 provided at an end thereof, and at the other end, with a pair of mold-side arms 54*a*, 54*b* connected to both ends of a flat plate 57 integrally formed with the fixing member 52*a*. A threaded portion 51*a* at the upper part of the rotating shaft 51 penetrates a hole 52*b* provided in the fixing member 52*a* of the rotating arm 52 and is screwed to a fixing nut 55, whereby the rotating shaft 51 is fixed to the rotating arm 52.

Prior to actual centrifugal casting, the rotating arm has to be balanced in weight, since otherwise vibration is induced in the rotating arm during rotation thereof, thus adversely affecting the quality of casting and rendering the casting impossible in extreme case. Thus, balancing of the rotating arm is important. For this reason, prior to fixing the rotating arm 52 to the rotating shaft 51, the balance of the rotating arm 52 is adjusted while it is in an unfixed free state as shown in FIG. 9. That is, a weight (indicated by numeral 2 in FIG. 1) provided on the balance-side arm 53, is adjusted in the horizontal position in such a manner that the rotating arm 52 is balanced at a lower groove 52*c* of the fixing member 52*a*, on a pin 56 radially penetrating the threaded portion 51*a* of the rotating shaft 51 and serving as a fulcrum.

After the rotating arm 52 is balanced as explained above, it is fixed to the rotating shaft 51. Subsequently the metal in the crucible (indicated by numeral 3 in FIG. 1) provided on the mold-side arms 54*a*, 54*b* is melted by the high frequency induction coil, then the coil is kept away from the crucible, and the rotating arm is rotated to pour the molten metal in the crucible into the mold (indicated by numeral 4 in FIG. 1). In this operation, the molten metal in the crucible starts to cool, because the supply of heat has already been removed, and is relatively rapidly cooled depending on the kind of the metal. If the temperature of the molten metal to be poured into the mold becomes too low by the cooling, there tends to result incomplete filling or cracks in the casting. It is therefore necessary to pour the molten metal from the crucible to the mold as quickly as possible after the termination of heat supply, and to rotate the rotating arm at least at more than a predetermined speed in order to obtain at least a predetermined centrifugal force.

In consideration of the foregoing, how to promptly cause the rotating arm to reach the predetermined speed is an important factor for the casting quality. FIG. 10 shows the relationship between the rotating speed $\omega$ and the time T. The rotating speed, at which the molten metal jumps out of the crucible by the centrifugal force is assumed as $\omega_n$. According to a solid-lined speed curve A in FIG. 10, the time from the start of rotation to the casting can be reduced by $(T_2-T_1)$ in comparison with a chain-lined speed curve B. The speed curve A is preferable for the casting quality, since it can reach the rotating speed $\omega_n$ faster and can thus reduce the casting time in comparison with the speed curve B.

However, acceleration to the high-speed of the rotating arm as shown in the speed curve A inevitably involves a rapid variation in the speed, and leads to the following drawbacks. As shown in FIG. 10, the rotating arm is subjected to acceleration by rapid speed increase in an area M, and is subjected to an inverse force by deceleration in an area N, so that in the conventional apparatus shown in FIG. 9, the fixing nut 55 for fixing the rotating arm 52 to the rotating shaft 51 is given a rotating torque and is loosened during the rotation. The tightening force of the fixing nut 55 cannot be made strong enough since the force is transmitted through the pin 56, and the contact area between the pin 56 and the groove 52*c* of the fixing member 52*a* of the rotating arm 52 is limited and can only provide a limited friction force, thus the nut 55 is easily loosened. For this reason, the rotating arm cannot perform proper rotation, giving undesirable influence on the casting.

It is also conceived to increase the diameter of the pin 56 in order to increase the tightening force or the frictional force mentioned above, but such increased diameter of the pin 56 leads to an increased size of the rotating shaft, with an increased weight thereof, which is unfavorable for the acceleration of the rotating arm.

SUMMARY OF THE INVENTION

An object of the present invention is to provide a centrifugal casting apparatus capable of providing satisfactory casting quality without loosening in the fixation of the rotating arm, even in the presence of a rapid speed variation, in the high-speed rotation of the rotating arm after the heat source is removed from the crucible containing the molten metal.

Another object of the present invention is to provide a centrifugal casting apparatus capable of adjusting easily and steady the balance of the rotating arm, which is important for attaining satisfactory casting quality in the centrifugal casting.

In one aspect of the present invention, the centrifugal casting apparatus is provided with a rotating shaft 51, a rotating arm 1 fixed to the rotating shaft 51, casting means composed of a crucible 3, a mold 4 and the like, and provided at an end of the rotating arm 1, balance means composed of a weight 2 and the like, and provided at the other end of the rotating arm 1, and fixing means 12*a*, 12*b* for fixing the rotating shaft 51 and the rotating arm 1 and so provided that the position of the fixation is deviated from the rotational center 15 of the rotating shaft 51.

According to the apparatus, since the fixing means 12*a*, 12*b* for fixing the rotating shaft 51 and the rotating arm 1 are deviated from the rotational center 15 of the rotating shaft 57, they are not subjected to rotating torque even under a speed variation of the rotating arm 1, so that the fixing means 12*a*, 12*b* are not loosened.

The fixing means 12*a*, 12*b* are preferably provided in a pair relative to the rotational center 15 in order to enhance the fixing effect.

In another aspect of the present invention, the centrifugal casting apparatus is provided with a rotating shaft, a rotating arm fixed to the rotating shaft, casting means 3, 4 provided at an end of the rotating arm, balance means 2 provided at the other end of the rotating arm, and fulcrum members 18*a*, 18*b* provided on the rotating shaft or the rotating arm for balancing the rotating arm, wherein the fulcrum members 18*a*, 18*b* being adapted to protrude from a member on which the fulcrum members are provided when the balance of the rotating arm is adjusted, and to be retracted into the member when the rotating arm and the rotating shaft are fixed each other.

According to the apparatus, the balance adjustment of the rotating arm 1 is facilitated because the fulcrum members 18*a*, 18*b* protrude from the member 51 on which the fulcrum members are provided upon balance adjustment, and also the fixation of the rotating arm 1 and the rotating shaft 51 can be achieved easily and sufficiently since the fulcrum members are retracted into the member 51 upon fixation.

In this case holes 20*a*, 20*b* in which the fulcrum members 18*a*, 18*b* can be housed, are preferably provided on the rotating shaft 51 and provided therein with spring members 19*a*, 19*b*.

In still another aspect of the present invention, the centrifugal casting apparatus is provided with a rotating shaft, a rotating arm fixed to said rotating shaft, casting means provided at an end of the rotating arm, and balance means provided at the other end of the rotating arm, wherein engaging part 24 is provided between the rotating shaft and the rotating arm to connect the rotating arm to the rotating shaft, and includes faces 11*a*, 11*b*, 13*a*, 13*b* inclined relative to the rotating shaft.

In this case, the engaging part 24 is preferably composed of a recessed portion 14*a* having inclined lateral faces 11*a*, 11*b*, and a protruding portion 14*b* having lateral faces 13*a*, 13*b* inclined corresponding to the inclined faces 11*a*, 11*b*. Also, the rotating arm 1 is preferably provided with a fixing member 13 in which a protruding portion 14*b* or a recessed portion 32 is formed.

According to the apparatus, the rotating shaft 51 and the rotating arm 1 are fixed to each other at the engaging part 24, which is provided with inclined faces 11*a*, 11*b*, 13*a*, 13*b* inclined relative to the rotating shaft 51. Thus, even if the engaging part 24 is positioned in the rotational center 15 of the rotating arm 1, the external force caused by the rotating torque upon variation of the rotating speed is received by the inclined faces 11*a*, 11*b*, 13*a*, 13*b*, so that the external force applied to the contact portions 11*c*, 13*c* is reduced, the contact portions 11*c*, 13*c* being made upon fixation of the rotating shaft 51 and the rotating arm 1, thus the fixation at the contact portions 11*c*, 13*c* cannot be loosened.

DETAILED DESCRIPTION OF THE PREFERRED EMBODIMENTS

Figure 9:
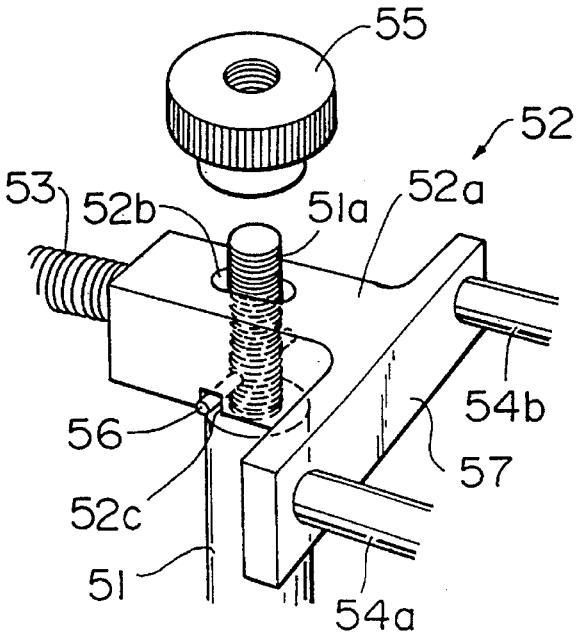
FIG. 9 PRIOR ART
FIG. 9 is a perspective view showing the connecting part between the rotating arm and the rotating shaft in a conventional centrifugal casting apparatus.

The present invention will be described in detail by embodiments 1 to 5 thereof, with reference to the attached drawings. The elements in the drawings equivalent to those in FIG. 9 are represented by the same numbers and will not be explained further.

Embodiment 1

Figure 1:
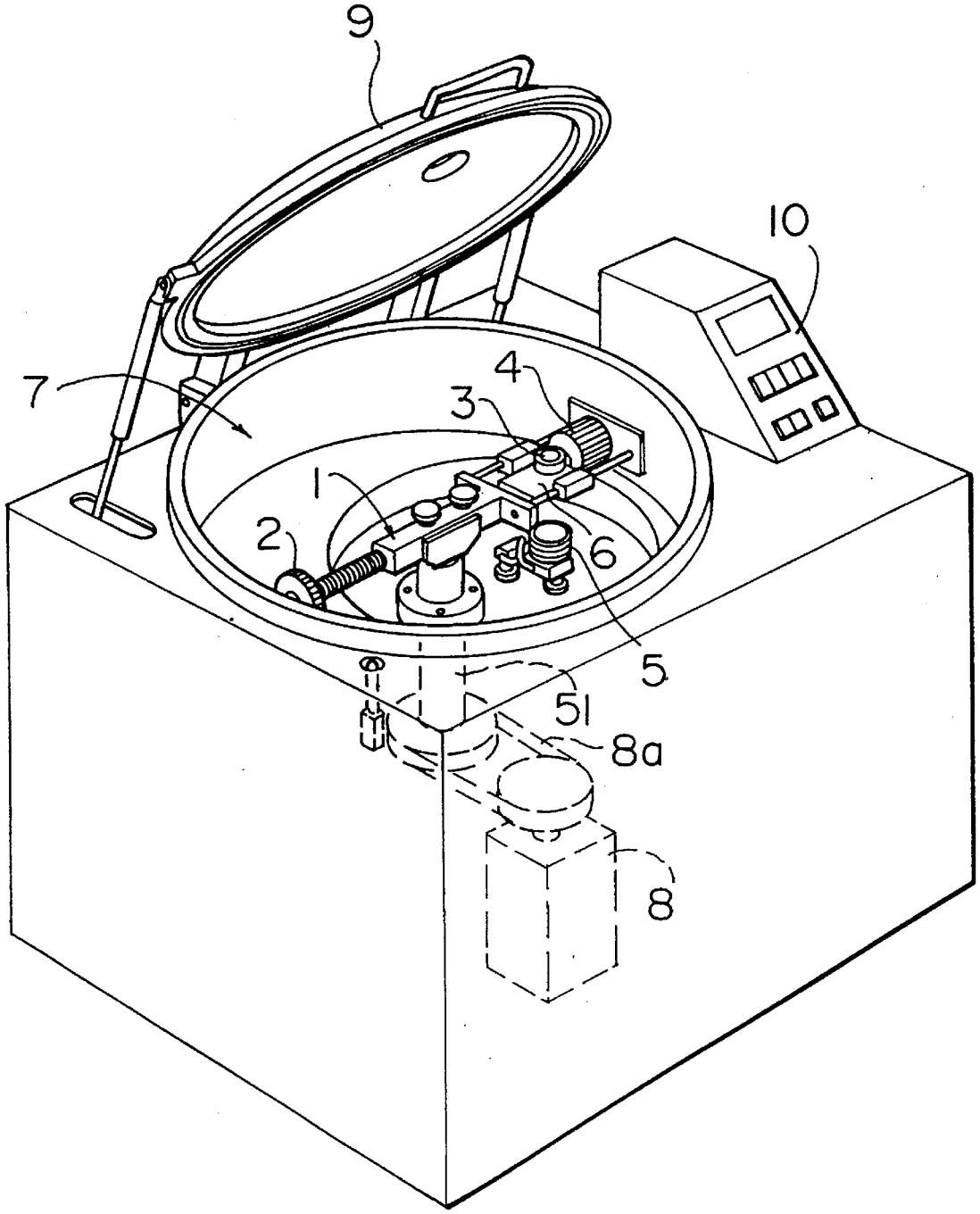
FIG. 1 is a perspective view of the entire centrifugal casting apparatus constituting an embodiment 1 of the present invention.

FIG. 1 illustrates the entire centrifugal casting apparatus of the embodiment 1.

The centrifugal casting apparatus is provided, on the upper face of a table-shaped body, with a cylindrical casting chamber 7 in which the rotating arm 1 is provided. The mold-side arms 54*a*, 54*b* of the arm 1 is provided with a crucible receiver 6 for receiving the crucible 3 and a mold 4. The balance-side arm 53 having a threaded portion is provided with a disk-shaped weight 2 engaging with the threaded portion. The weight 2 is horizontally movable on the arm 53 upon balance adjustment of the rotating arm 53. A high frequency induction coil 5 is provided under the crucible 3 fixed to the crucible receiver 6. The coil is elevated upon melting of the metal in the crucible 3 and is lowered upon centrifugal casting by an elevator mechanism (not shown).

The rotating shaft 51 is provided so as to penetrate the bottom of the casting chamber 7, and is driven by a variable-speed servo motor 8 through a belt 8*a*, thereby rotating the rotating arm 1. The casting chamber 7 is provided with a cover 9 for covering the casting chamber 7 for safety during the casting operation. At the side of the casting chamber 7, there is provided a control panel 10 for controlling various operations of the casting.

Figure 2:
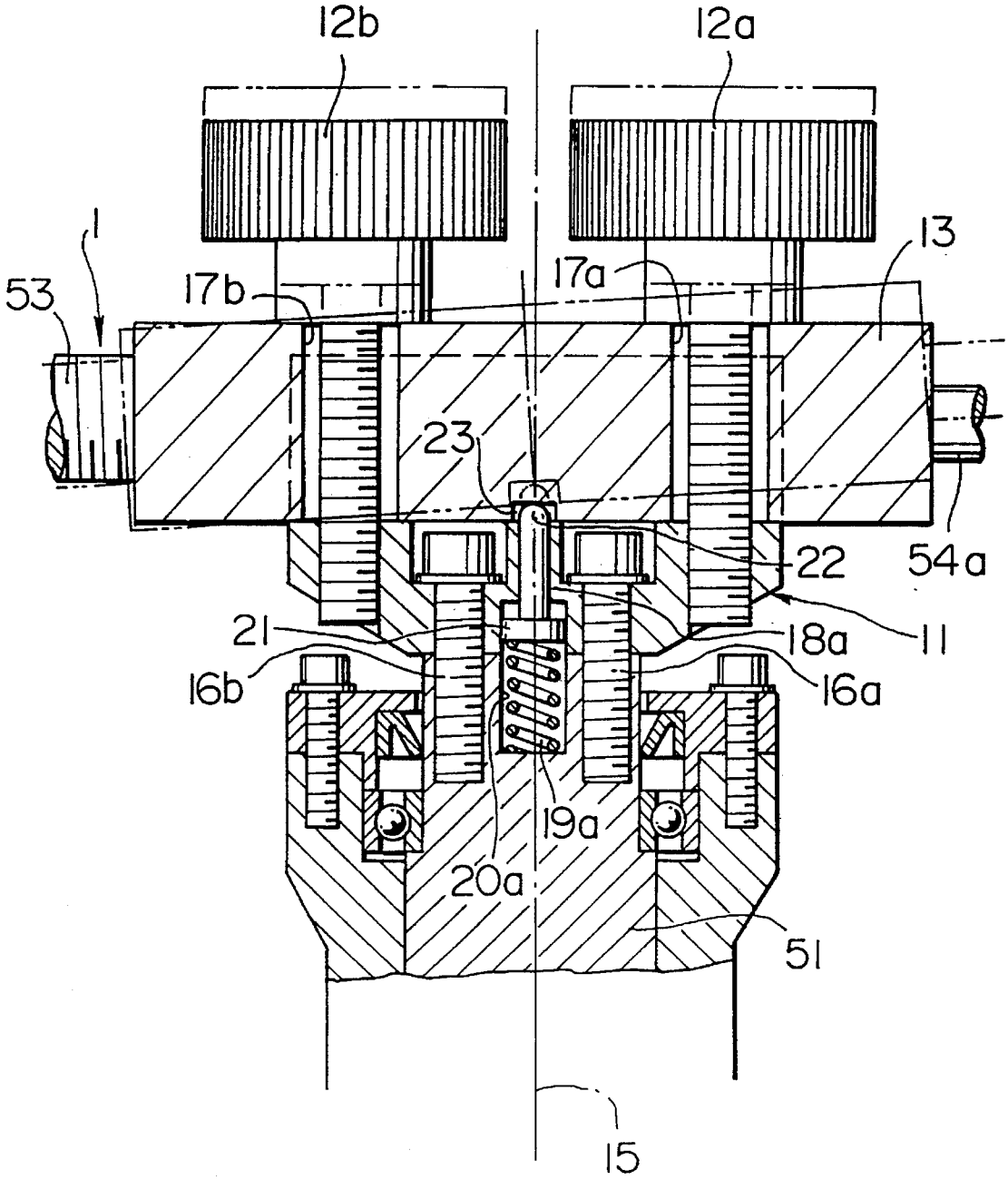
FIG. 2 is a vertical cross-sectional view, seen from a direction II—II in FIG. 4, of a connecting portion between the rotating arm and the rotating shaft of the apparatus shown in FIG. 1.
Figure 3:
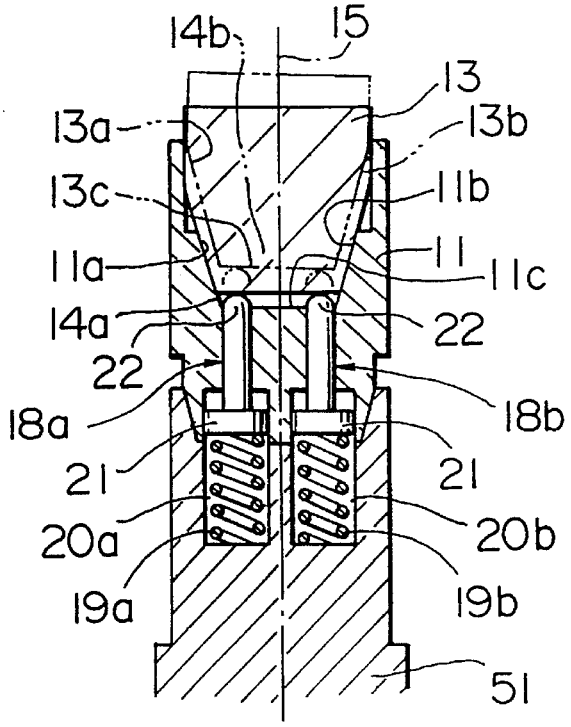
FIG. 3 is a vertical cross-sectional view, seen from a direction III—III in FIG. 4, of a connecting portion between the rotating arm and the rotating shaft of the apparatus shown in FIG. 1.
Figure 4:
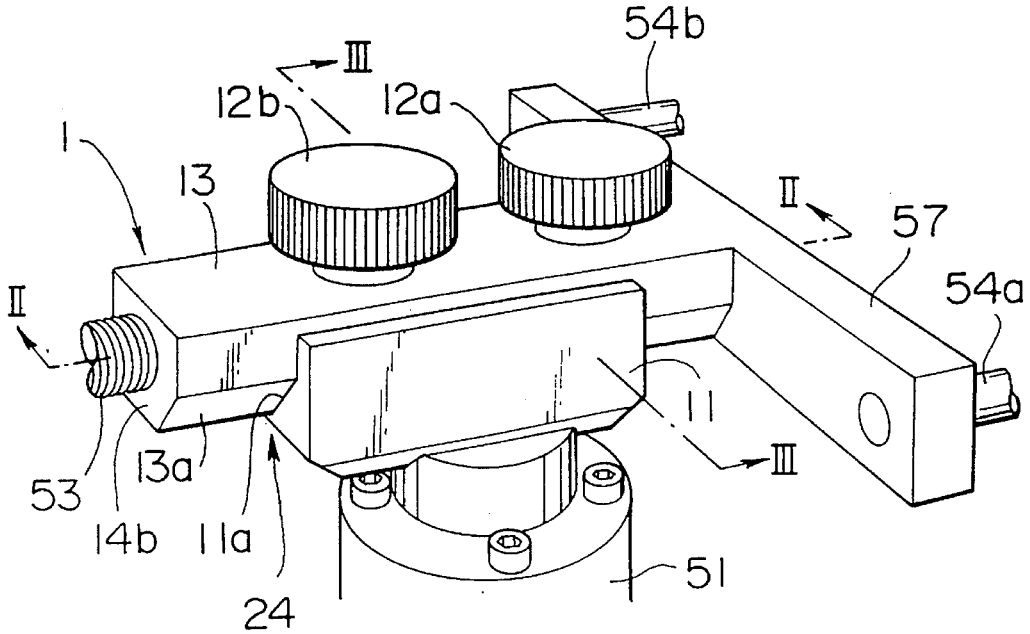
FIG. 4 is a perspective view showing the connecting portion between the rotating arm and the rotating shaft of the apparatus shown in FIG. 1.

FIGS. 2 to 4 illustrate the connecting structure of the rotating arm 1 and the rotating shaft 51 of the present embodiment. FIGS. 2 and 3 are vertical cross-sectional views of the coupling portion shown in FIG. 4. The rotating arm 1 and the rotating shaft 51 are connected and fixed in the following manner.

The rotating arm 1 is provided, at a rotational center portion, with an arm fixing member 13, of which lower part is formed as an inverse trapezoid and constitutes a downward protruding portion 14*b*. The protruding portion 14*b* includes inclined faces 13*a*, 13*b* which are linearly inclined with respect to the rotational center 15 of the rotating shaft 51. The arm fixing member 13 is provided, at positions deviated from the rotational center 15 and symmetrically thereto, with a pair of bolt holes 17*a*, 17*b*, and is fixed by means of arm fixing bolts 12*a*, 12*b* to an engaging member 11 to be explained later.

Under the arm fixing member 13, there is provided the engaging member 11 engaging with the fixing member 13 and constituting a recessed portion 14*a*, matching the shape of the protruding portion 14*b* of the fixing member 13. The recessed portion 14*a* is provided with inclined faces 11*a*, 11*b* corresponding to the inclined faces 13*a*, 13*b* of the fixing member 13. The engaging member 11 is provided with threaded holes for engaging with the bolts 12*a*, 12*b*. The arm fixing member 13 is fixed to the engaging member 11 by the bolts 12*a*, 12*b* at the positions deviated from the rotational center 15. In this state, the lower face 13*c* of the fixing member 13 intimately contacts the bottom face 11*c* of the engaging member 11. The engaging member 11 is fixed to the rotating shaft 51 by means of bolts 16*a*, 16*b*. A connecting part 24 is so constructed that the rotating arm 1 and the rotating shaft 51 are connected by the protruding portion 14*b* of the arm fixing member 13 and the recessed portion 14*a* of the engaging member 11.

As explained in the foregoing, the rotating arm 1 is fixed at the arm fixing member 13 to the rotating shaft 51 through the engaging member 11 by means of the fixing bolts 12*a*, 12*b* and the connecting part 24.

In the following there will be explained the fulcrum structure of the present embodiment with reference to FIGS. 2 and 3.

In the upper part of the rotating shaft 51 there are provided spring-containing holes 20*a*, 20*b* in which compression coil springs 19*a*, 19*b* are housed. Fulcrum pins 18*a*, 18*b* each having a flange 21 and a semispherical end 22 are so positioned that the flanges 21 are in contact with the upper ends of the springs 19*a*, 19*b* and the ends 22 penetrate holes provided in the engaging member 11 and protrude from the bottom face 11*c* of the recessed portion of the engaging member 11. As shown in FIG. 3, the fulcrum pins 18*a*, 18*b* are linearly aligned in such a manner that the center thereof coincides with the rotational center 15 as shown in FIG. 2.

In a state in which the fixing member 13 of the rotating arm 1 is mounted and fixed onto the engaging member 11 as shown in FIGS. 2 and 3, the fulcrum pins 18*a*, 18*b* are depressed at the ends 22 against the upward force of the springs 19*a*, 19*b* and are retracted into the holes 20*a*, 20*b*. On the lower face of the arm fixing member 13 there is provided a fulcrum groove 23, whose center corresponds to the rotational center 15 of the rotating shaft 51. The ends 22 of the fulcrum pins 18*a*, 18*b* are fitted into the groove 23.

When balancing the rotating arm 1 is adjusted, the arm fixing bolts 12*a*, 12*b* are sufficiently loosened to release the coupling between the fixing member 13 of the rotating arm 1 and the engaging member 11, whereby the fulcrum pins 18*a*, 18*b* retracted in the holes 20*a*, 20*b* protrude upwards by the upward force of the springs 19*a*, 19*b*. Thus, as indicated by chain lines in FIGS. 2 and 3, the fixing member 13 of the rotating arm 1 is lifted by the fulcrum pins 18*a*, 18*b*, in a state of a lever supported by the ends 22 of the fulcrum pins 18*a*, 18*b* fitting in the groove 23 of the fixing member 13. In this state the weight 2 on the balance-side arm 53 of the rotating arm 1 is laterally moved so that the rotating arm is balanced.

Figure 10:
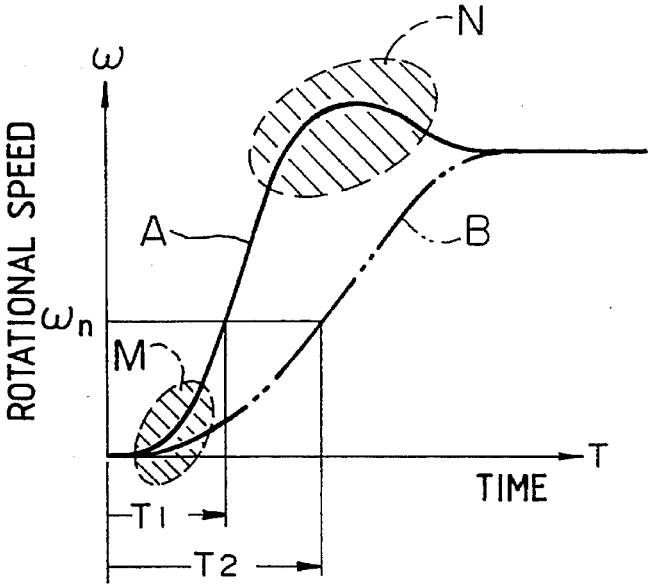
FIG. 10 is a chart showing the relationship between the rotating speed ω of the rotating arm and the time T.

In the connecting mechanism of the rotating arm 1 and the rotating shaft 51 shown in FIGS. 2 to 4, the paired fixing nuts 12*a*, 12*b* for fixing the arm fixing member 13 to the engaging member 11 attached to the rotating shaft 51, are not subjected to the loosening torque as in the case of the conventional fixing nut 55 shown in FIG. 9, because the fixing nuts 12*a*, 12*b* are deviated from the rotational center 15. Also, since the arm fixing bolts 12*a*, 12*b* can be sufficiently tightened, the lower face 13*c* of the arm fixing member 13 contacts the bottom face 11*c* of the engaging member 11 with a sufficiently large area, whereby a sufficient frictional force can be obtained. Consequently, the arm fixing bolts 12*a*, 12*b* are never loosened by the rotation of the rotating arm 1 in the course of casting operation, and the rotating arm 1 can continue stable rotation. This fact is particularly advantageous in the case that it is required to reach the predetermined rotating speed ($\omega_n$ in FIG. 10) as quickly as possible after the start of rotation of the rotating arm, in relation to the casting quality.

Also the balance adjustment of the rotating arm 1 prior to the casting operation can be conducted simply and securely with high efficiency because the fulcrum pins 18*a*, 18*b* automatically protrude from the bottom face 11*c* of the recessed portion of the engaging member 11 by the function of the springs 19*a*, 19*b* and serve as fulcrum.

Also, in the casting operation, the fixing operation of the rotating arm 1 and the fixing shaft 51 can be achieved extremely efficiently since, the arm fixing member 13 is fixed to the engaging member 11 with the arm fixing bolts 12*a*, 12*b* whereby the fulcrum pins 18*a*, 18*b* are automatically retracted into the holes of the engaging member 11 and the spring-containing holes 20*a*, 20*b*, compressing the coil springs 19*a*, 19*b*. Such fulcrum structure is particularly advantageous in the case that the arm fixing bolts are provided in the positions deviated from the rotary center 15.

Furthermore, when the rotating arm 1 is fixed to the rotating shaft 51, the arm fixing member 13 and the engaging member 11 mutually engage at the inclined faces 13*a*, 13*b*, 11*a*, 11*b* of the protruding portion 14*b* and the recessed portion 14*a* thereof, and the rotating torque (force to move the arm fixing member 13 relative to the rotating shaft 51) generated during the rotation of the rotating arm is received by the inclined faces, so that the arm fixing member 13 is not displaced relative to the engaging member 11, at the lower face 13*c* and the bottom face 11*c*, and hence is not loosened in the horizontal direction. The inclined face structure at the connecting portion further stabilizes the rotation of the rotating arm 1.

In the following embodiments 2 to 5 will be explained with reference to FIGS. 5 to 8. The same elements as those in the embodiment 1 will be numbered in the same manner and will not be explained further.

Embodiment 2

Figure 5:
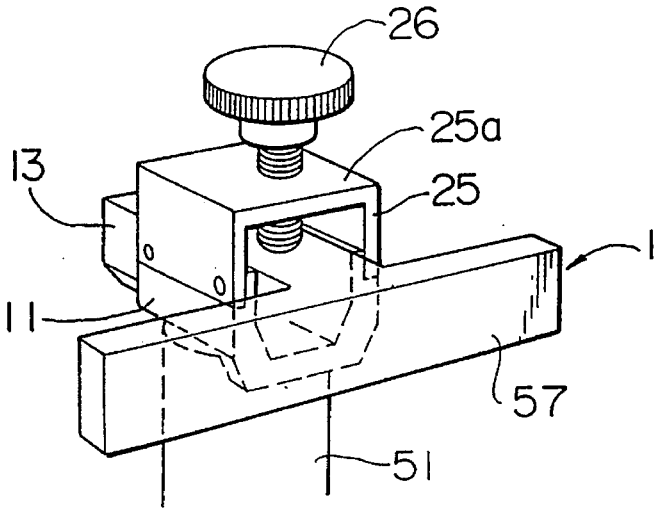
FIG. 5 is a perspective view showing the connecting portion between the rotating arm and the rotating shaft of a centrifugal casting apparatus constituting an embodiment 2 of the present invention.

FIG. 5 illustrates the embodiment 2, in which the engaging member 11 of the embodiment 1 shown in FIGS. 2 to 4 is provided with a gate-shaped member 25. An arm fixing bolt 26 engaging with a threaded hole of the upper face 25*a* of the gate-shaped member 25 is pressed to the arm fixing member 13 from above, thereby achieving the fixation of the arm fixing member 13 and the engaging member 11. The position of the arm fixing bolt 26 is deviated from the rotational center 15 of the rotating shaft 51. The arm fixing bolt may be provided in plurality, but the operating efficiency is better with only one bolt. In FIG. 5, the balance-side arm and the mold-side arm are omitted from the illustration.

Embodiment 3

Figure 6:
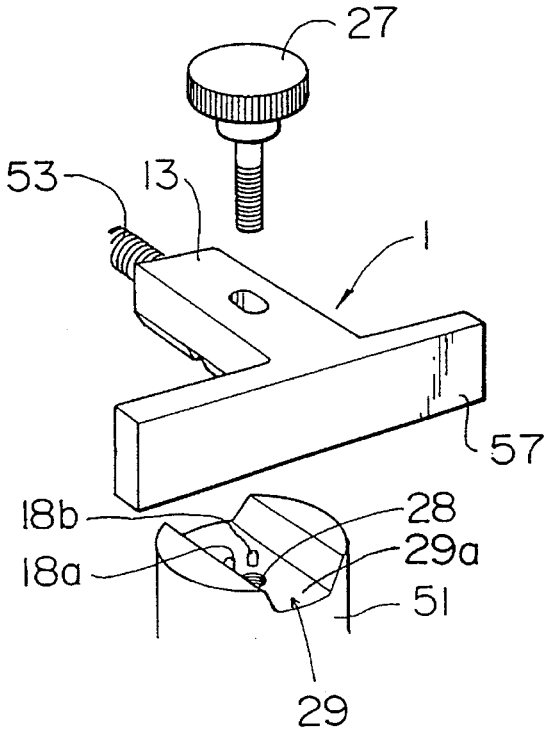
FIG. 6 is a perspective view showing the connecting portion between the rotating arm and the rotating shaft of a centrifugal casting apparatus constituting an embodiment 3 of the present invention.

FIG. 6 illustrates the embodiment 3, in which the engaging member 11 in the embodiment 1 shown in FIGS. 2 to 4 is omitted and a recessed portion 29 corresponding to that of the engaging member 11 of the embodiment 1, is directly provided on the upper end of the rotating shaft 51. The fulcrum pins 18*a*, 18*b* and a threaded hole 28, for engaging with the arm fixing bolt 27, are provided on the bottom face 29*a* of the recessed portion 29. The arm fixing bolt 27 penetrates the arm fixing member 13 and fits into the threaded hole 28 at a position deviated from the rotational center 15, thereby fixing the fixing member 13 to the rotating shaft 51. The arm fixing bolt may be provided in plurality, but the operating efficiency is better with only one bolt. The mold-side arms are omitted from the illustration.

Embodiment 4

Figure 7:
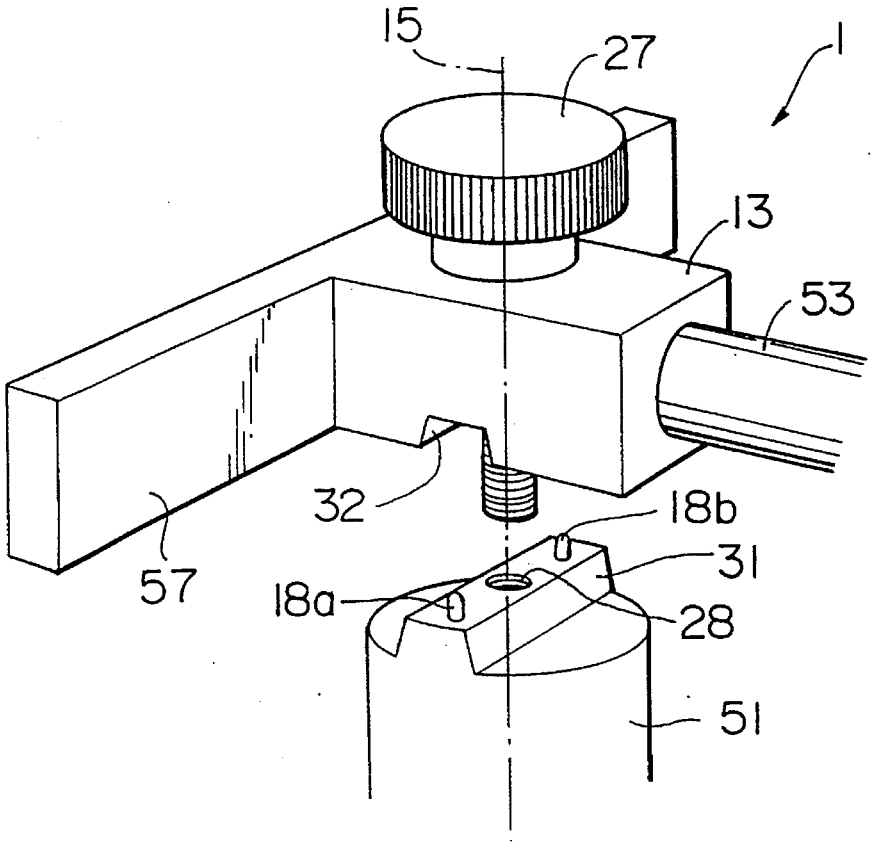
FIG. 7 is a perspective view showing the connecting portion between the rotating arm and the rotating shaft of a centrifugal casting apparatus constituting an embodiment 4 of the present invention.

FIG. 7 shows the embodiment 4, in which the recessed portion 29 shown in FIG. 6 is replaced by a trapezoidal protruding portion 31 provided on the rotating shaft 51. On the upper face 31*a* of the protruding portion 31 is provided with the fulcrum pins 18*a*, 18*b* and the threaded hole 28 for engaging with the arm fixing bolt 27. On the lower face of the fixing member 13 of the rotating shaft 1 there is formed a recessed portion 32 of a shape matching the protruding portion 31. The arm fixing bolt 27 penetrates the arm fixing member 13 and is fitted into the threaded hole 28, thereby fixing the fixing member 13 to the rotating shaft 51. In the present embodiment the threaded hole 28 is positioned at the rotational center 15 between the fulcrum pins 18*a*, 18*b*, so that the fixing bolt 27 is also positioned on the rotational center 15, but it is more preferably positioned out of the rotational center as explained above. The mold-side arms are omitted from the illustration.

Embodiment 5

Figure 8:
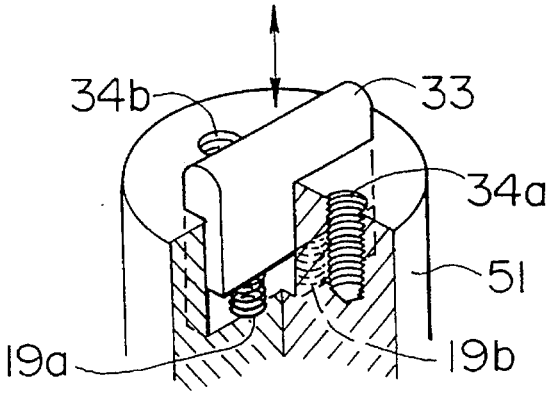
FIG. 8 is a perspective view showing the upper end portion of the rotating shaft of a centrifugal casting apparatus constituting an embodiment 5 of the present invention.

FIG. 8 illustrates the structure of the rotating shaft of the embodiment 5, in which the fulcrum pins 18*a*, 18*b* in the embodiment 1 are replaced by a fulcrum member 33 with a semicylindrical upper end, and threaded holes 34*a*, 34*b* for fitting with the arm fixing bolts are formed on both sides of the fulcrum member 33, deviated from the rotational center. The fulcrum member 33 is also vertically movable, protruding by the function of the springs 19*a*, 19*b* from the upper face of the rotating shaft 51, and is retracted into the rotating shaft 51, when necessary. The arm fixing member may be so constructed as to match the rotating shaft 51 shown in FIG. 8. Also, in this embodiment, the connecting portion may be provided with recessed and protruding portions as shown in FIGS. 6 and 7.

The embodiments 2 to 5 are particularly advantageous for simpler structures, for lower rotating speed than in the embodiment 1.

Also in the foregoing embodiments, the fulcrum structure including the fulcrum pins and the like is provided on the rotating shaft, but it may also provided on the rotating arm.

According to the foregoing embodiment explained above, the fixing means is positioned out of the center of rotation and is not given the rotating torque even in the presence of variation of speed of the rotating arm, so that it cannot be loosened. Consequently the rotating arm can maintain stable rotation during the casting operation and can also achieve a higher rotating speed, thereby attaining higher casting quality.

Also, according to the embodiment, the fulcrum member which protrudes or retracts according to the necessity enables simple and secure balance adjustment of the rotating arm and assures simple and sufficient fixation of the rotating arm and the rotating shaft, thereby attaining the higher casting quality.

Further, according to the embodiments, the inclined faces provided in the connecting portion between the rotating shaft and the rotating arm reduce the external force applied to the connecting portion, thereby preventing the loosening thereof. Consequently, the rotating arm can maintain stable rotation during the casting operation and can achieve a higher rotating speed, thereby attaining higher casting quality.

Although the present invention has been described by the embodiments thereof, the present invention is not limited thereto and is subject to various modifications within the scope and spirit of the invention.

What is claimed is:

1. A centrifugal casting apparatus, comprising:

a rotating shaft;

a rotating arm fixed to said rotating shaft;

casting means provided at an end of said rotating arm;

balance means provided at the other end of said rotating arm; and fixing means for fixing said rotating arm to said rotating shaft at a fixing position deviated from a rotational center of said rotating shaft.

2. An apparatus according to claim 1, wherein a pair of said fixing means are provided relative to the rotational center.

3. An apparatus according to claim 1, further comprising a fulcrum member provided in said rotating shaft or said rotating arm and for adjusting balance of said rotating arm, said fulcrum member being adapted, when the balance of said rotating arm is adjusted, to protrude from a member on which said fulcrum member is provided, and to retract into said member when said rotating arm and said rotating shaft are fixed each other.

4. An apparatus according to claim 1 wherein an engaging part is provided between the rotating shaft and the rotating arm to connect the rotating arm to the rotating shaft, and includes faces inclined relative to said rotating shaft.

5. A centrifugal casting apparatus, comprising:

a rotating shaft;

a rotating arm fixed to said rotating shaft;

casting means provided at an end of said rotating arm;

balance means provided at the other end of said rotating arm; and a fulcrum member provided in said rotating shaft or said rotating arm for adjusting balance of said rotating arm, said fulcrum member being adapted, when the balance of said rotating arm is adjusted, to protrude from a member on which said fulcrum member is provided, and to retract into said member when said rotating arm and said rotating shaft are fixed each other.

6. An apparatus according to claim 5, wherein said rotating shaft is provided with a hole in which said fulcrum member can be housed, and a spring member is provided in said hole.

7. An apparatus according to claim 5, wherein an engaging part is provided between said rotating shaft and said rotating arm to connect the rotating arm to the rotating shaft, and includes faces inclined relative to said rotating shaft.

8. A centrifugal casting apparatus, comprising:

a rotating shaft;

a rotating arm fixed to said rotating shaft;

casting means provided at an end of said rotating arm; and balance means provided at the other end of said rotating arm;

wherein an engaging part is provided between engaging said rotating shaft and said rotating arm to connect the rotating arm to the rotating shaft and include faces inclined relative to said rotating shaft.

9. An apparatus according to claim 8, wherein said engaging parts includes a recessed portion with inclined side walls and a protruding portion with side walls inclined corresponding to the inclined side walls of said recessed portion.

10. An apparatus according to claim 9, wherein said rotating arm includes a fixing member in which said recessed or protruding portion is provided.

11. A centrifugal casting apparatus comprising:

a rotating shaft;

a rotating arm fixed to said rotating shaft;

casting means provided at an end of said rotating arm;

balance means provided at the other end of said rotating arm;

fixing means for fixing said rotating shaft and said rotating arm at a fixing position deviated from the center of rotation of said rotating shaft; and a fulcrum member provided on said rotating shaft or said rotating arm for adjusting balance of said rotating arm, said fulcrum member being adapted, when the balance of said rotating arm is adjusted, to protrude from a member on which said fulcrum member is provided, and to retract into said member when said rotating arm and said rotating shaft are fixed each other;

wherein an engaging part is provided between said rotating shaft and said rotating arm to connect the rotating arm to the rotating shaft, and includes faces inclined relative to said rotating shaft.

12. An apparatus according to claim 11, wherein said a pair of fixing means are provided relative to the rotational center.

13. An apparatus according to claim 11, wherein said rotating shaft includes a hole in which said fulcrum member can be housed, and a spring member is provided in said hole.

14. An apparatus according to claim 11, wherein said engaging parts are composed of a recessed portion with inclined side walls, and a protruding portion with side walls inclined matching the inclined side walls of said recessed portion.

15. An apparatus according to claim 14, wherein said rotating arm includes a fixing member on which said recessed portion or protruding portion is provided.

* * * * *